US011657950B2

(12) United States Patent
Jeon et al.

(10) Patent No.: US 11,657,950 B2
(45) Date of Patent: May 23, 2023

(54) MAGNETIC COMPOSITE SHEET AND COIL COMPONENT

(71) Applicant: SAMSUNG ELECTRO-MECHANICS CO., LTD., Suwon-si (KR)

(72) Inventors: Jong Ok Jeon, Suwon-si (KR); Jeong Ho Lim, Suwon-si (KR); Il Jin Park, Suwon-si (KR); Soon Kwang Kwon, Suwon-si (KR); Gwang Hwan Hwang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 296 days.

(21) Appl. No.: 16/901,501

(22) Filed: Jun. 15, 2020

(65) Prior Publication Data

US 2021/0225575 A1 Jul. 22, 2021

(30) Foreign Application Priority Data

Jan. 22, 2020 (KR) ..... 10-2020-0008228

(51) Int. Cl.
*H01F 27/255* (2006.01)
*H01F 17/04* (2006.01)
(Continued)

(52) U.S. Cl.
CPC ..... *H01F 27/255* (2013.01); *H01F 1/24* (2013.01); *H01F 1/26* (2013.01); *H01F 17/0013* (2013.01);
(Continued)

(58) Field of Classification Search
None
See application file for complete search history.

(56) References Cited

U.S. PATENT DOCUMENTS 10,497,505 B2 12/2019 Lee et al.
11,183,320 B2 * 11/2021 Tonoyama ..... B22F 1/16
(Continued)

FOREIGN PATENT DOCUMENTS

CN 102610362 A 7/2012
CN 104575942 A 4/2015
(Continued)

OTHER PUBLICATIONS

Office Action issued in corresponding Korean Patent Application No. 10-2020-0008228 dated Feb. 2, 2021, with English translation.
(Continued)

*Primary Examiner* — Kevin M Bernatz
(74) *Attorney, Agent, or Firm* — Morgan, Lewis & Bockius LLP

(57) ABSTRACT

A coil component includes a body and a coil portion embedded in the body, wherein the body comprises a first magnetic metal powder particle comprising a core represented by Formula 1 below, and an oxide film comprising at least one of silicon (Si) and chromium (Cr) and formed on a surface of the core, a second magnetic metal powder particle having a larger diameter than the first magnetic metal powder particle, and a third magnetic metal powder particle having a larger diameter than the second magnetic metal powder particle:

$Fe_aSi_bCr_c$ [Formula 1]

where 3 atom %≤b≤6 atom %, 2.65 atom %≤c≤3.65 atom %, and a+b+C=100.

18 Claims, 11 Drawing Sheets

C

(51) Int. Cl.

| | |
|---|---|
| ***H01F 27/32*** | (2006.01) |
| ***H01F 1/24*** | (2006.01) |
| ***H01F 1/26*** | (2006.01) |
| ***H01F 17/00*** | (2006.01) |
| ***H01F 1/153*** | (2006.01) |

(52) U.S. Cl.
CPC ..... *H01F 17/04* (2013.01); *H01F 27/32* (2013.01); *H01F 1/15308* (2013.01); *H01F 2017/048* (2013.01)

(56) References Cited

U.S. PATENT DOCUMENTS

| | | | | |
|---|---|---|---|---|
| 2012/0188046 | A1 | 7/2012 | Matsuura et al. | |
| 2013/0076477 | A1 | 3/2013 | Kino | |
| 2013/0154784 | A1* | 6/2013 | Hachiya | H01F 5/003 336/200 |
| 2015/0102888 | A1 | 4/2015 | Kim et al. | |
| 2015/0371752 | A1* | 12/2015 | Park | H01F 27/255 336/200 |
| 2016/0042859 | A1* | 2/2016 | Park | H01F 17/04 336/200 |
| 2016/0055955 | A1* | 2/2016 | Park | H01F 27/255 336/83 |
| 2016/0126004 | A1* | 5/2016 | Yang | H01F 27/292 336/90 |
| 2016/0314889 | A1* | 10/2016 | Ryu | H01F 41/0246 |
| 2017/0243689 | A1* | 8/2017 | Yoon | H01F 17/04 |
| 2018/0061550 | A1* | 3/2018 | Lee | H01F 27/292 |
| 2019/0006100 | A1* | 1/2019 | Bong | H01F 17/0013 |
| 2019/0198221 | A1* | 6/2019 | Choi | H01F 27/255 |
| 2019/0279802 | A1 | 9/2019 | Yoshidome et al. | |
| 2020/0168375 | A1* | 5/2020 | Park | H01F 17/0013 |
| 2020/0203994 | A1* | 6/2020 | Cho | H02J 50/12 |
| 2020/0219644 | A1* | 7/2020 | Kim | H01F 27/2804 |
| 2020/0219645 | A1* | 7/2020 | Jeong | H01F 27/2804 |
| 2021/0005365 | A1* | 1/2021 | Jung | H01F 27/327 |
| 2022/0102047 | A1* | 3/2022 | Lee | H01F 27/022 |
| 2022/0157513 | A1* | 5/2022 | Lee | H01F 27/292 |

FOREIGN PATENT DOCUMENTS

| | | | |
|---|---|---|---|
| CN | 107785149 | A | 3/2018 |
| KR | 10-2013-0069385 | A | 6/2013 |
| KR | 10-1565700 | B1 | 11/2015 |
| KR | 10-2017-0097852 | A | 8/2017 |
| KR | 10-2018-0025068 | A | 3/2018 |
| KR | 10-1881952 | B1 | 7/2018 |
| KR | 10-2019-0001676 | A | 1/2019 |
| KR | 10-2019-0106792 | A | 9/2019 |
| KR | 10-2025709 | B1 | 9/2019 |

OTHER PUBLICATIONS

Office Action issued in corresponding Chinese Patent Application No. 202010960009.2 dated Sep. 5, 2022, with English translation.

* cited by examiner

A

C

MAGNETIC COMPOSITE SHEET AND COIL COMPONENT

CROSS-REFERENCE TO RELATED APPLICATION(S)

This application claims the benefit of priority to Korean Patent Application No. 10-2020-0008228 filed on Jan. 22, 2020, in the Korean Intellectual Property Office, the disclosure of which is incorporated herein by reference in its entirety.

BACKGROUND

1. Field

The present disclosure relates to a magnetic composite sheet and a coil component.

2. Description of Related Art

An inductor, one of a coil component, is a representative passive element utilized in an electronic device together with a resistor and a capacitor.

As for a thin film coil component, a type of coil component, a body is formed by forming a coil portion on at least one surface of a substrate followed by stacking a magnetic complex sheet containing a magnetic metal powder particle on the substrate.

In regard to the above, there may be a case in which a body is formed using a magnetic complete sheet containing two or more different magnetic metal powder particles having different diameters to improve characteristics of the coil component by improving a percentage of a magnetic body (magnetic metal powder particle) of the body.

As the diameter of the magnetic metal powder particle decreases, it becomes more difficult to form an insulating film on the surface of the magnetic metal powder particle, thereby decreasing insulation resistance of the body.

In addition, entire insulation resistance of the body may be reduced due to a reduced distance between the magnetic metal powder particles when a charging rate of the magnetic metal powder particle is improved to improve the magnetic body percentage of the body.

SUMMARY

An aspect of the present disclosure may provide a coil component and a magnetic composite sheet capable of easily reducing leakage current among coil components containing least three or more magnetic metal powder particle having different diameters.

According to an aspect of the present disclosure, a coil component includes a body and a coil portion embedded in the body, wherein the body comprises a first magnetic metal powder particle comprising a core comprising a compound represented by Formula 1 below, and an oxide film comprising at least one of silicon (Si) or chromium (Cr) and formed on a surface of the core, a second magnetic metal powder particle having a larger diameter than the first magnetic metal powder particle, and a third magnetic metal powder particle having a larger diameter than the second magnetic metal powder particle:

$$Fe_aSi_bCr_c \quad \text{[Formula 1]}$$

where 3 atom %≤b≤6 atom %, 2.65 atom %≤c≤3.65 atom %, and a+b+C=100.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
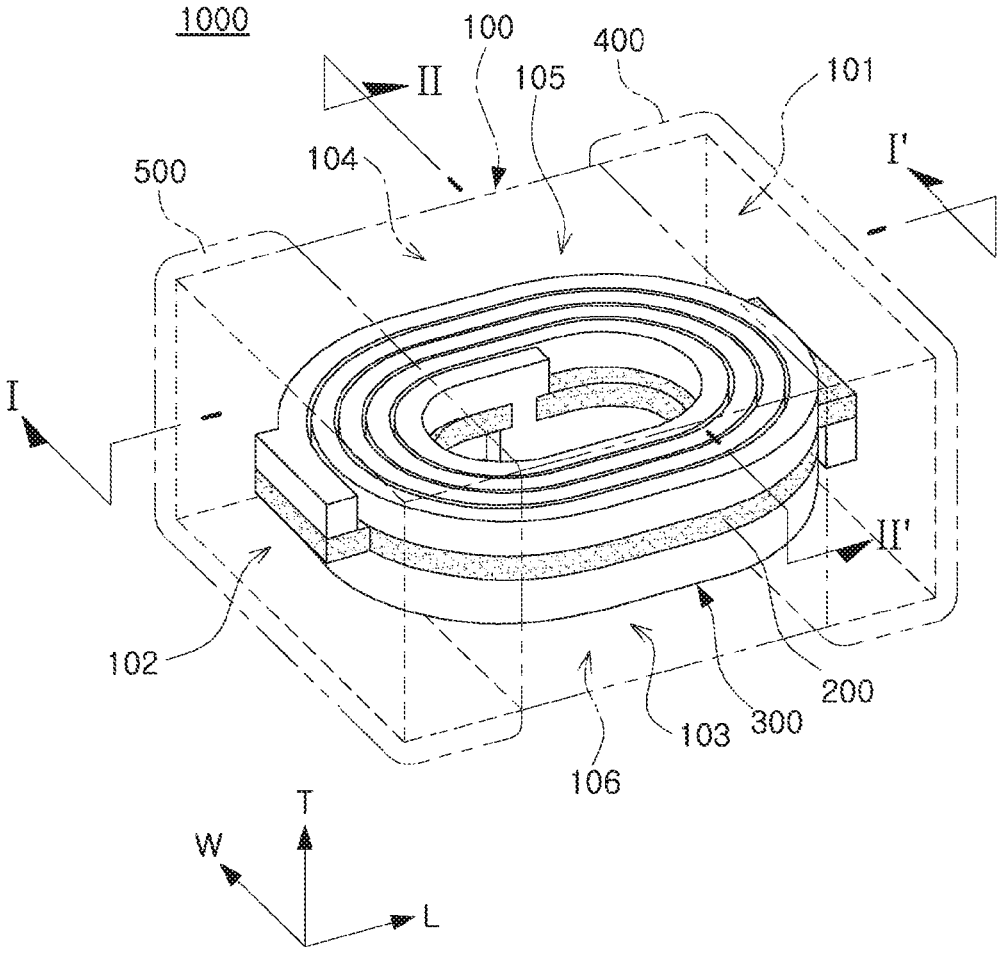
FIG. 1 is a schematic diagram illustrating a coil component according to an exemplary embodiment of the present disclosure.

Hereinbelow, terms referring to the elements of the present disclosure are named in consideration of the functions of the respective elements, and thus should not be understood as limiting the technical elements of the present disclosure. As used herein, singular forms may include plural forms as well unless the context explicitly indicates otherwise. Further, as used herein, the terms "include", "have", and their conjugates denote a certain feature, numeral, step, operation, element, component, or a combination thereof, and should not be construed to exclude the existence of or a possibility of addition of one or more other features, numerals, steps, operations, elements, components, or combinations thereof. In addition, it will be the term "on" does not necessarily mean that any element is positioned on an upper side based on a gravity direction, but means that any element is positioned above or below a target portion.

Throughout the specification, it will be understood that when an element or layer is referred to as being "connected to" or "coupled to" another element or layer, it can be understood as being "directly connected" or "directly coupled" to the other element or layer or intervening elements or layers may be present. It will be further understood that the terms "comprises," "comprising," "includes," and/or "including" specify the presence of elements, but do not preclude the presence or addition of one or more other elements.

The size and thickness of each component illustrated in the drawings are represented for convenience of explanation, and the present disclosure is not necessarily limited thereto.

In the drawings, the expression "W direction" may refer to "first direction" or "width direction," and the expression "L direction" may refer to "second direction" or "length direction" while the expression "T direction" may refer to "third direction" or "thickness direction".

A value used to describe a parameter such as a 1-D dimension of an element including, but not limited to, "length," "width," "thickness," "diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

In electronic devices, various types of electronic components may be used, and various types of coil components may be appropriately used between the electronic components to remove noise, or for other purposes.

In other words, a coil component in electronic devices may be used as a power inductor, a high frequency inductor, a general bead, a high frequency (GHz) bead, a common mode filter, or the like. Hereinafter, exemplary embodiments of the present disclosure will now be described in detail with reference to the accompanying drawings. The same or corresponding components were given the same reference numerals and will not explained further.

Figure 2:
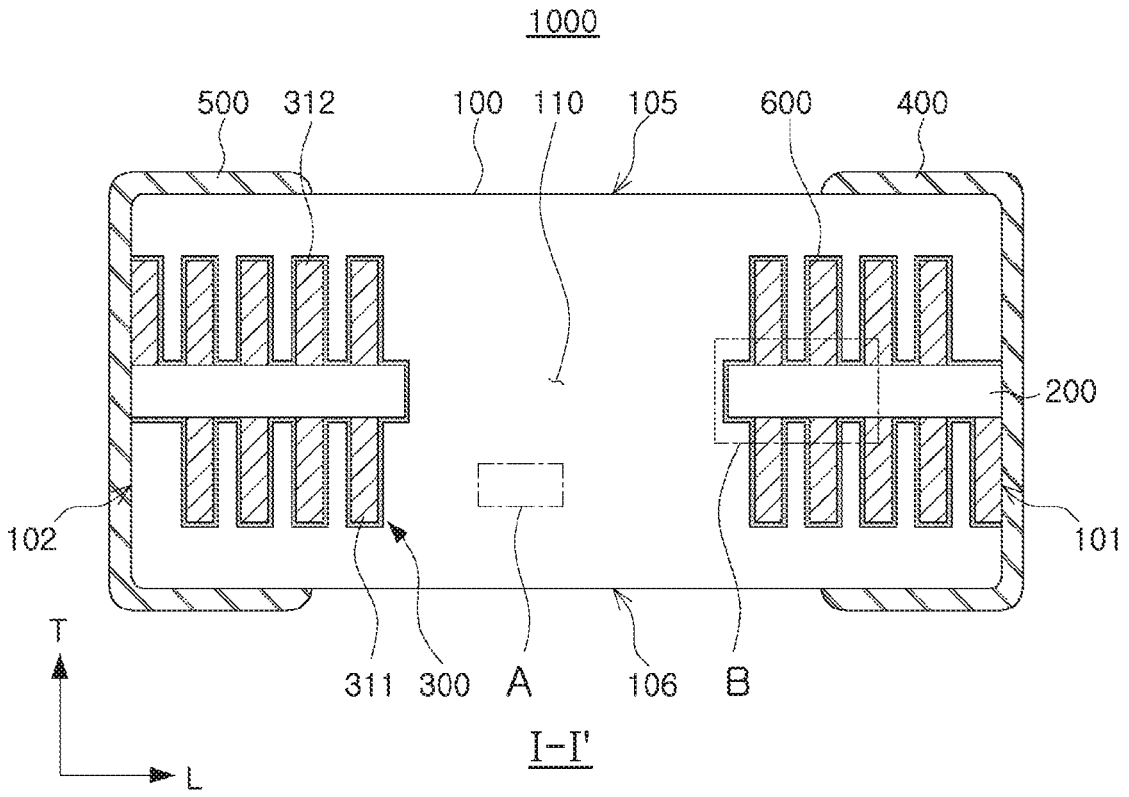
FIG. 2 is a cross-sectional view taken along line I-I' of FIG. 1.
Figure 3:
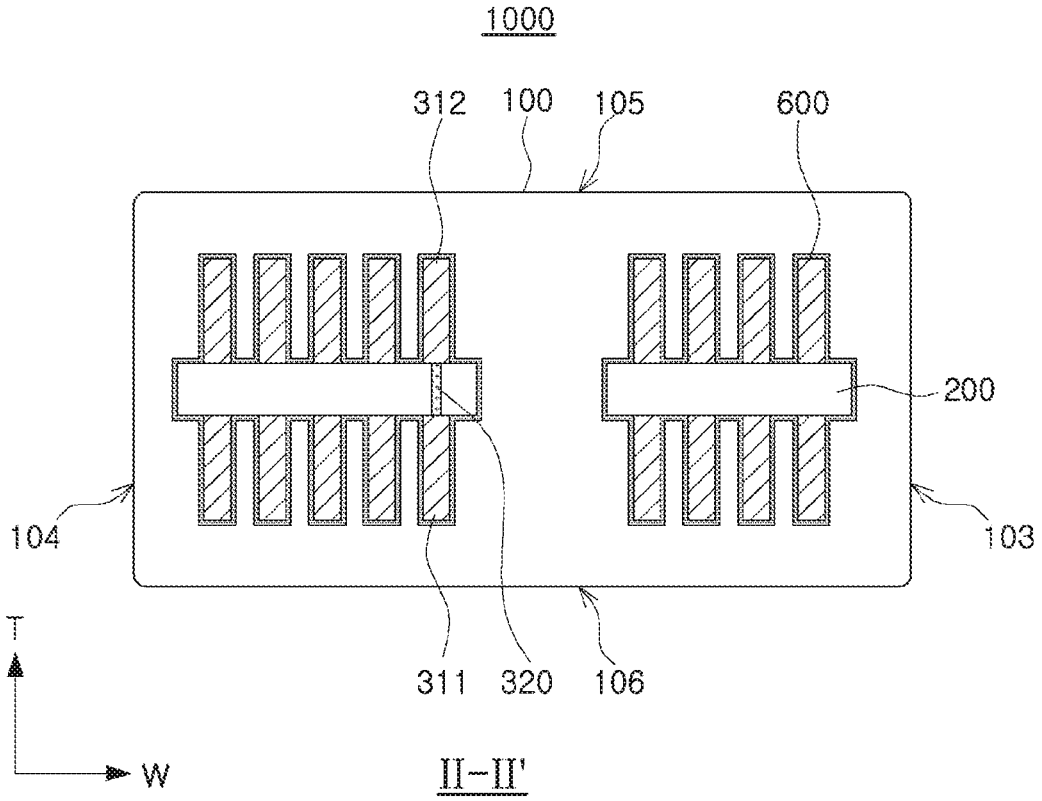
FIG. 3 is a cross-sectional view taken along line II-II' of FIG. 1.
Figure 4:
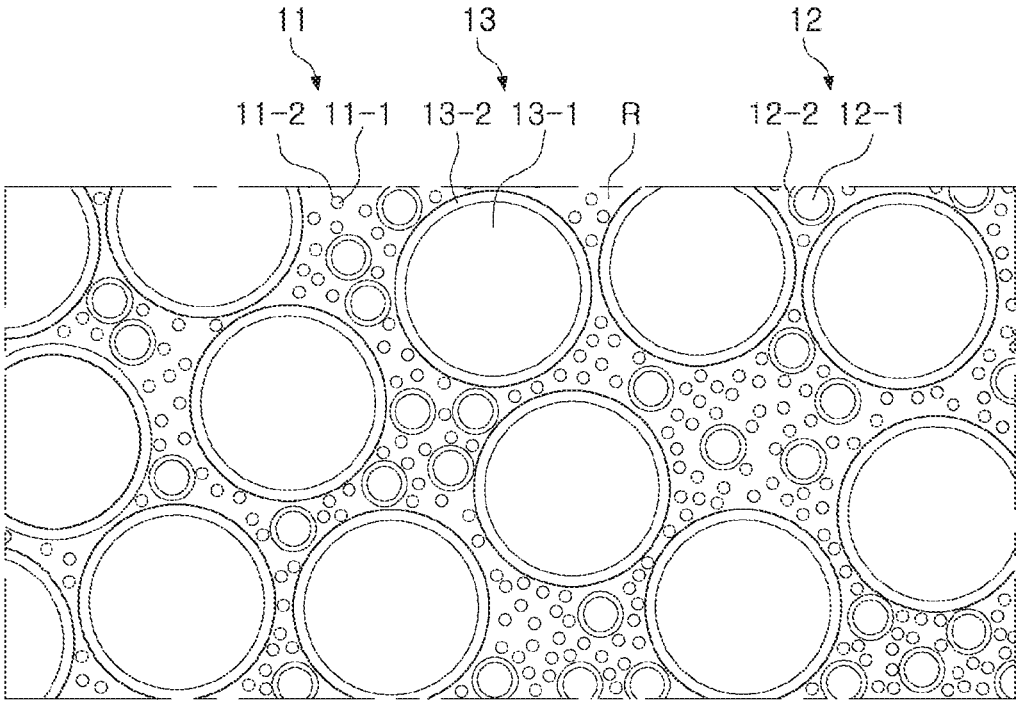
FIG. 4 is an enlarged view of "A" of FIG. 2.
Figure 5:
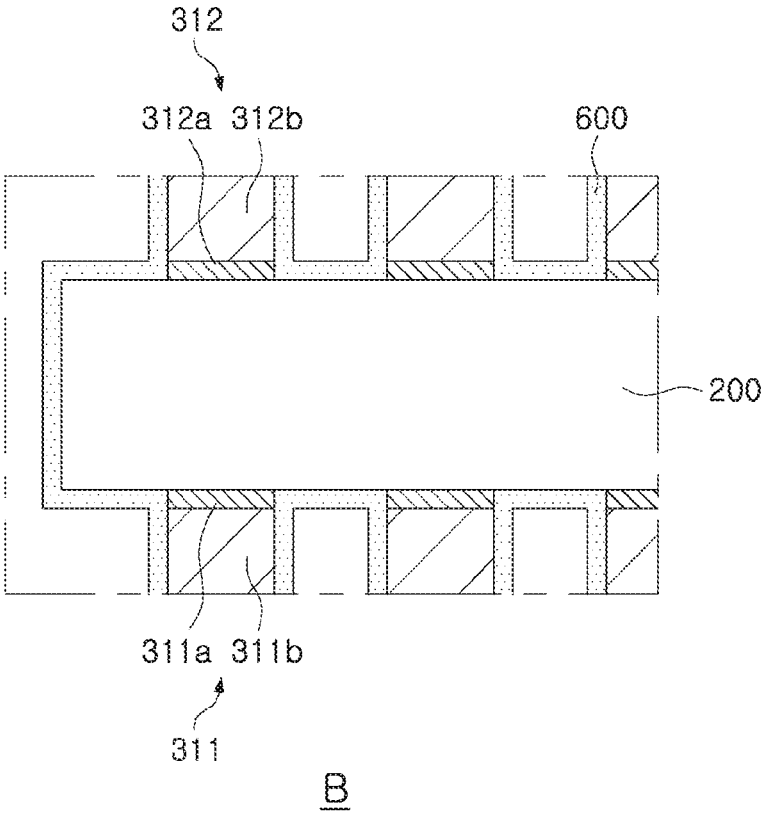
FIG. 5 is an enlarged view of "B" of FIG. 2.
Figure 6:
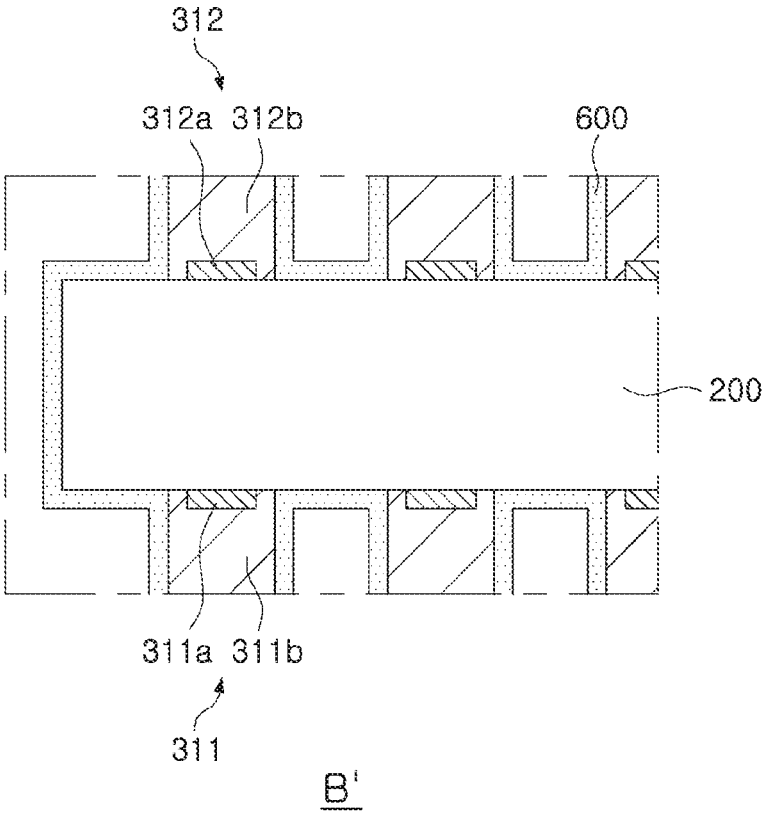
FIG. 6 is a modified example of "B" of FIG. 2'.

FIG. 1 is a schematic diagram illustrating a coil component according to an exemplary embodiment of the present disclosure, and FIG. 2 is a cross-sectional view taken along line I-I' of FIG. 1. FIG. 3 is a cross-sectional view taken along line II-II' of FIG. 1, while FIG. 4 is an enlarged view of "A" of FIG. 2, and FIG. 5 is an enlarged view of "B" of FIG. 2. FIG. 6 is a modified example of "B" of FIG. 2.

Based on FIGS. 1 to 6, a coil component 1000 according to an exemplary embodiment includes a body 100, an insulating substrate 200, a coil portion 300 and external electrodes 400 and 500, and may further include an insulating film 600.

The body 100 may form an exterior of the coil component 1000, and may bury the coil portion 300 in the body 100.

The body 100 may have a hexahedral shape.

Based on FIGS. 1 to 3, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. The first to fourth surfaces 101 to 104 of the body 100 may be walls of the body 100 connecting the fifth surface 105 and the sixth surface 106 of the body 100. In the description below, the expression "both end surfaces of the body" may refer to the first surface 101 and the second surface 102 of the body 100, and the expression "both side surfaces of the body" may refer to the third surface 103 and the fourth surface 104 of the body 100 while the expression "one surface of the body" may refer to the sixth surface 106 of the body 100 and the expression "the other surface of the body" may refer to the fifth surface 105 of the body. Further, the expression "upper and lower surfaces of the body may refer to the fifth and sixth surfaces 105 and 106 of the body 100 defined with respect to the direction of FIGS. 1 to 3.

The body 100 may be formed such that the coil component 1000 according to an exemplary embodiment including external electrodes 400 and 500 has a thickness of 0.85 mm or less. As an example, the body 100 may be configured such that the coil component 1000 in which the external electrodes 400 and 500 are formed may have a length of 2.0 mm, a width of 1.2 mm, and a thickness of 0.85 mm. Alternately, the body may be configured such that the coil component 1000 in which the external electrodes 400 and 500 are formed may have a length of 2.0 mm, a width of 1.6 mm, and a thickness of 0.55 mm, or a length of 2.0 mm, a width of 1.2 mm, and a thickness of 0.55 mm. Alternately, the body may be configured such that the coil component 1000 in which the external electrodes 400 and 500 are formed may have a length of 1.2 mm, a width of 1.0 mm, and a thickness of 0.55 mm, but is not limited thereto. The sizes of the coil component 1000 indicated above are merely examples, and thus, the present disclosure is not limited thereto. An overall thickness of the component of 0.85 mm or less falls within the scope of the present disclosure. The thickness can be measured by a method other than the micrometer method, which is appreciated by the one skilled in the art. In the previously described examples, each value of the widths and thicknesses are not applied with process errors. When compared with the above numerical values, the case having a difference which can be recognized as a process error falls within the scope of the present disclosure.

A thickness of the coil component may be obtained by measuring the thickness of the component using a micrometer. The thickness of the component may refer an arithmetic mean of thicknesses of a plurality of components (for example, 30). Each of the thickness of the components is obtained by the above-mentioned micrometer method. A length of the coil component and a width of the coil component could be obtained by the above-mentioned micrometer method, and by the above-mentioned arithmetic mean method.

The body 100 may contain magnetic metal powder particles 11 to 13 and an insulating resin R. Specifically, the body 100 may be formed by layering one or more magnetic composite sheets containing the magnetic metal powder particles 11 to 13 dispersed in the resin R followed by curing the magnetic composite sheet. The magnetic metal powder particles 11 to 13 contain a first magnetic metal powder particle 11, a second magnetic metal powder particle 12 having a larger diameter than the first magnetic metal powder particle 11, and a third magnetic metal powder particle 13 having a larger diameter than the second magnetic metal powder particle 12. In the present exemplary embodiment, as the body 100 contains three or more types of the magnetic metal powder particles 11 to 13 having different diameters, a charging ratio of a magnetic body of the body 100 can be enhanced, and characteristics of a component, such as inductance, can be improved. As used herein, the expression "diameter" of the magnetic metal powder particles 11 to 13 may refer to particle distribution such as $D_{50}$ or $D_{90}$. Accordingly, different diameters of the magnetic metal powder particles 11 to 13 may refer to different numerical values of the particle distribution, such as $D_{50}$ or $D_{90}$.

The insulating resin R may contain epoxy, polyimide, a liquid crystal polymer, or the like, independently or a mixture thereof, but is not limited thereto.

The first magnetic metal powder particle 11 is described below.

The second and third magnetic metal powder particles 12 and 13 contain magnetic metal particles 12-1 and 13-1 and insulating layers 12-2 and 13-2 surrounding the magnetic metal particles 12-1 and 13-1, respectively, and containing an insulating resin R'. The insulating resin R' may be the same or different material from the insulating resin R included in the body, which filled with all the part of the space not occupied by the first, second and third magnetic metal powder particles.

The magnetic metal particles 12-1 and 13-1 may contain at least one selected from the group consisting of iron (Fe), silicon (Si), chromium (Cr), cobalt (Co), molybdenum (Mo), aluminum (Al), niobium (Nb), copper (Cu), boron (B) and nickel (Ni). For example, each of the magnetic metal particles 12-1 and 13-1 may be a Fe—Si—B—Nb—Cu-base alloy powder.

The magnetic metal particles 12-1 and 13-1 may contain at least one selected from the group consisting of Fe, Si, Cr, Co, Mo, Al, Nb, Cu and Ni. For example, the magnetic metal particles 12-1 and 13-1 may contain at least one of a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, a Fe—Cr—Al alloy powder or a Fe—Si—B—Nb—Cu alloy powder.

The magnetic metal particles 12-1 and 13-1 may be amorphous or crystalline. For example, the magnetic metal particles 12-1 and 13-1 may be a Fe—Si—B—Nb—Cu alloy powder may be a crystal grain containing iron silicide ($Fe_3Si$) in an amorphous matrix, but is not limited thereto.

The insulating coating layers 12-2 and 13-2 may contain an electrically insulating resin, such as an epoxy resin or a polyimide resin, but are not limited thereto. The insulating coating layers 12-2 and 13-2 may have a thickness of greater than 0.01 μm and less than 1 μm, but are not limited thereto. A thickness of the insulating coating layers 12-2 may be obtained by an arithmetic mean of thicknesses of the insulating coating layers 12-2 of one particular particle of the second magnetic metal powder particles shown in SEM image or TEM image. The insulating coating layers 12-2 and 13-2 may be formed on surfaces of the magnetic metal particles 12-1 and 13-1 by immersing the magnetic metal particles 12-1 and 13-1 in a liquid insulating resin and drying the same, but are not limited thereto. The thickness can be measured by a method other than the method of using SEM image or TEM image, which is appreciated by the one skilled in the art.

A diameter of the second magnetic metal powder particle 12 may be greater than that of the first magnetic metal powder particle 11, and a diameter of the third magnetic metal powder particle 13 may be greater than that of the second magnetic metal powder particle 12. As an example, the diameter of the first magnetic metal powder particle 11 may be less than 1 μm. More preferably, the diameter of the first magnetic metal powder particle 11 may be 0.1 μm to 0.2 μm. The diameter of the second magnetic metal powder particle 12 may be 1 μm to 2 μm, and the diameter of the third magnetic metal powder particle 13 may be 25 μm to 30 μm. In the case in which the diameter of the second magnetic metal powder particle 12 is beyond said range, the magnetic body charging percentage of the body 100 may be reduced. In the case in which the diameter of the third magnetic metal powder particle 13 is below 25 μm, the magnetic body charging percentage of the body 100 may be reduced. When the diameter of the third magnetic metal powder particle 13 exceeds 30 μm, occurrence of an outer appearance defect may increase and a binding force between the external electrodes 400 and 500 and the body 100 may decrease while plating spreading may be generated during plating of the external electrodes 400 and 500.

The first magnetic metal powder particle 11 includes a core 11-1 represented by Formula 1 below, and an oxide film 11-2 formed on a surface of the core 11-1 and containing at least one of Si or Cr:

$$Fe_aSi_bCr_c \quad \text{[Formula 1]}$$

where 3 atom %≤b≤6 atom %, 2.65 atom %≤c≤3.65 atom %, and a+b+C=100.

For trimodal (meaning that a coil component contains three types of magnetic metal powder particles with different diameters), an insulating coating layer is simply and easily formed on surfaces of a magnetic metal powder particle having a largest diameter (coarse magnetic metal powder particle) and that having a median diameter (fine powder magnetic metal powder particle) using a liquid phase process due to relatively large diameters thereof. In contrast, it is difficult to form an insulating coating layer on a surface of a magnetic metal powder particle having a smallest diameter (less than 1 μm; ultrafine magnetic metal powder particle) due to the current liquid phase process. Due to a short circuit between the ultrafine magnetic metal powder particles, leakage voltage may be reduced.

In the present disclosure, the above mentioned problems are resolved by the first magnetic metal powder particle 11, the ultrafine magnetic metal powder particle, by forming the core and the oxide film 11-2 having an oxidized surface itself on a surface of the core 11-1. The oxide film 11-2 is a native oxide and may thus contain at least one of Si or Cr contained in the core 11-1. That is, the oxide film 11-2 may contain at least one of a Si—O bonding or a Cr—O bonding. In the present disclosure, as the first magnetic metal powder particle 11 contains the core 11-1 and the oxide film 11-2, which is the native oxide of the core 11-1, insulation resistance of the first magnetic metal powder particle 11 can be obtained by a comparatively easy method.

By satisfying the composition of Formula 1, the core 11-1 may form an oxide film 11-2 having enhanced insulation resistance characteristics on a surface thereof. When a content (at o) of Si of the core 11-1 is less than the range of Formula 1, the oxide film 11-2 is insufficiently formed on the surface o f the core 11-1, thereby giving rise to reduced insulation resistance. This will be described below. When a content (at o) of Si of the core 11-1 exceeds the range of Formula 1, a volume accounted for by the oxide film 11-2 in the entire first magnetic metal powder particle 11 extremely increases, and the component characteristics, such as inductance, may decrease.

The body 100 includes a core 110 penetrating the coil portion 300, which will be described below. The core 110 may be formed by filling a penetrating hole of the coil portion 300 by at least a portion of a magnetic complex sheet in the process in which the magnetic composite sheet is stacked and cured, but is not limited thereto.

The insulating substrate 200 is embedded in the body 100. The insulating substrate 200 is configured to support the coil portion 300.

The insulating substrate 200 is formed of an insulating material such as a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer 200 may be formed of an insulating material such as prepreg, Ajinomoto Build-up Film (ABF), FR-4, a bismaleimide triazine (BT) resin, a photoimageable dielectric (PID), and the like, but an example of the material of the internal insulating layer is not limited thereto.

As the inorganic filler, one or more materials selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the insulating substrate 200 is formed of an insulating material including a reinforcing material, the insulating substrate 200 may provide improved stiffness. When the insulating substrate 200 is formed of an insulating material which does not include a glass fiber, the insulating substrate 200 is advantageous in component slimming. When the insulating substrate 200 is formed of an insulating material including a photosensitive insulating resin, a number of processes for forming the coil portion 300 may be reduced such that manufacturing costs are reduced, and it is advantageous in forming a fine via 320.

The coil portion 300 includes planar spiral coil patterns 311 and 312 and is buried in the body 100 to exhibit the characteristics of the coil component. For example, when the coil component 1000 is used as a power inductor, the coil portion 300 may store an electric field as a magnetic field such that an output voltage may be maintained, thereby stabilizing power of an electronic device.

The coil portion 300 may include coil patterns 311 and 312 and a via 320. Specifically, based on the directions of FIGS. 1 to 3, a first coil pattern 311 is disposed on a lower surface of the insulating substrate 200 facing the sixth surface 106 of the body 100, while the second coil pattern 312 is disposed on an upper surface of the insulating substrate. The via 320 penetrates the insulating substrate 200 to be in contact with inner end portions of the first and second coil patterns 311 and 312. This enables the coil portion 300, as a whole, to function as a single coil in which one or more turns are formed based on the core 110.

The first and second coil patterns 311 and 312 have a planar spiral shape in which at least one turn is formed based on the core 110. As an example, the first coil pattern 311 may form at least one turn based on the core 110 on the lower surface of the insulating substrate 200 with respect to the directions of FIGS. 1 to 3.

External ends of the first and second coil patterns 311 and 312 are exposed to the first and second surfaces 101 and 102, respectively, to be in contact with the first and second external electrodes 400 and 500. That is, the external end of the first coil pattern 311 is connected to the first external electrode 400 and that of the second coil pattern 312 is connected to the second external electrode 500.

The first coil pattern 311 includes a first conductive layer 311*a* contact-formed on the lower surface of the insulating substrate 200 based on the directions of FIGS. 4 and 5 and a second conductive layer 311*b* disposed on the first conductive layer 311*a*.

The first conductive layer 311*a* may be a seed layer for forming the second conductive layer 311*b* by electroplating. The first conductive layer 311*a*, the seed layer of the second conductive layer 311*b*, is formed to be thinner than the second conductive layer 311*b*. The first conductive layer 311*a* may be formed by an electroless plating process of a thin film process such as sputtering. When the conductive layer 311*a* is formed by a thin film process such as sputtering, at least a portion of materials forming the first conductive layer 311*a* may be permeated into the lower surface of the insulating substrate 200. This can be confirmed by the fact that a difference occurs in a concentration of a metal material forming the first conductive layer 311 in the insulating substrate 200 along a thickness direction T of the body 100.

A thickness of the first conductive layer 311*a* may be 1.5 μm to 3 μm. When the thickness of the first conductive layer 311*a* is less than 1.5 μm, the first conductive layer 311*a* is not easily achieved, thereby causing a plating defect to possibly occur in subsequent processes. When the thickness of the first conductive layer 311*a* is greater than 3 μm, it is difficult to form the second conductive layers 311*b* and 312*b* to have comparatively large volumes in a limited volume of the body 100. For example, based on any one turn of the first coil pattern 311 shown in the optical micrograph for the length-thickness cross-section (a LT cross-section) in the central portion of the body 100 in the width direction W, the thickness of the first conductive layer 311*a* may refer to, when the normal extends in the thickness direction T from one point of a line segment corresponding to one surface of the first conductive layer 311*a* contacting one surface of the support substrate 200 (the lower surface of the support substrate 200 based on the direction in FIGS. 5, 6), a distance from the one point to the other point at which the normal contacts a line segment corresponding to the other surface of the first conductive layer 311*a*, opposing one surface of the first conductive layer 311*a*.

Alternatively, for example, based on anyone turn of the first coil pattern 311 illustrated in the optical micrograph for the length-thickness cross-section (the LT cross-section) in the central portion of the body in the width direction W, when a plurality of normals extend in the thickness direction T from a plurality of one points of a line segment corresponding to one surface of the first conductive layer 311*a* contacting one surface of the support substrate 200 (the lower surface of the support substrate 200 based on the direction in FIGS. 5, 6), the thickness of the first conductive layer 311*a* may indicate an arithmetic mean of distances from the plurality of one points to a plurality of the other points at which the plurality of normals are in contact with a line segment corresponding to the other surface of the first conductive layer 311*a*, opposing one surface of the first conductive layer 311*a*.

Alternatively, based on the optical micrograph of the length-thickness cross-section (the LT cross-section) in the central portion of the body in the width direction W, the thickness of the first conductive layer 311*a* may indicate an arithmetic mean of respective thicknesses of the plurality of turns illustrated in the cross-sectional image by the above-described method.

The thickness can be measured by a method other than the method described above, which is appreciated by the one skilled in the art.

Based on FIG. 5, in some embodiments, at least a portion of a side surface of the first conductive layer 311*a* is exposed by the second conductive layer 311*b*. In the case of FIG. 5, a seed film for forming the first conductive layer 311*a* is formed on the entire lower surface of the insulating substrate 200, and a plating resist for forming the second conductive layer 311*b* is formed on the seed film. The second conductive layer 311*b* is then formed by electroplating followed by removing the plating resist and selectively removing the seed film on which the second conductive layer 311*b* is not formed, resulting in formation of the first coil pattern 311. Accordingly, the at least a portion of the side surface of the first conductive layer 311*a* formed by selectively removed seed film is not covered by the second conductive layer 311*b* but is exposed thereby. The seed film may be formed on the lower surface of the insulating substrate 200 by electroless plating or sputtering. Alternately, the seed film may be a cupper foil of a copper clad laminate (CCL). The plating resist may be formed by applying a material for forming the plating resist to the seed film and then performing a photolithography process. After the photolithography process, the plating resist may have an opening corresponding to a region in which the second conductive layer 311*b* is to be formed. The selective removal of the seed film may be performed by a laser process and/or an etching process. When the seed film is selectively removed by etching, the first conductive layer 311*a* may be formed in the form in which a cross-sectional area increases as it approaches the insulating substrate 200 from the second conductive layer 311*b*.

Based on FIG. 6, in some embodiments, the second conductive layer 311*b* covers the first conductive layer 311*a*. In contrast to FIG. 5, FIG. 6 involves forming the planar spiral first conductive layer 311*a* on the lower surface of the insulating substrate 200 and the second conductive layer 311*b* on the first conductive layer 311*a* by electroplating. When the second conductive layer 311*b* is formed by anisotropic plating, a plating resist may not be used, but the present disclosure is not limited thereto. That is, when the second conductive layer 311*b* is formed, a plating resist for forming the second conductive layer may be used. An opening exposing the first conductive layer 311*a* is formed in the plating resist for forming the second conductive layer. A diameter of the opening may be larger than a line width of the first conductive layer 311*a*, and as a result, the second conductive layer 311*b* filling the opening covers the side surface of the first conductive layer 311*a* and 312*a* to be in contact with the insulating substrate 200.

Meanwhile, the descriptions above regarding the first and second conductive layers 311*a* and 311*b* of the first coil pattern 311 may be similarly applied to the first and second conductive layers 312*a* and 312*b* of the second coil pattern 312.

The via 320 may include at least one conductive layer. As an example, when the via 320 is formed by electroplating, the via 320 may include a seed layer formed on an inner wall of a via hole penetrating the insulating substrate 200 and an electroplating layer filling the via hole in which the seed layer is formed. The seed layer of the via 320 may be integrally formed with the first conductive layers 311*a* and 312*a* in the same process, or formed in different processes thereby forming a boundary therebetween. The electroplating layer of the via 320 may be integrally formed with the second conductive layers 311*b* and 312*b* in the same process, or formed in different processes thereby forming a boundary therebetween.

When the line width of the coil patterns 311 and 312 is extremely large, a volume accounted for by the magnetic body in the body 100 is reduced, thereby negatively affecting inductance. As a non-limited example, an aspect ratio (AR) of the coil patterns 311 and 312 may be 3:1 to 9:1.

The coil patterns 311 and 312 and the via 320 may be formed of Cu, Al, Ag, Sn, Au, Ni, Pd, Ti, Cr or alloys thereof, but are not limited thereto. As a non-limited example, when the first conductive layers 311*a* and 312*a* are formed by sputtering and the second conductive layers 311*b* and 312*b* are formed by electroplating, the first conductive layers 311*a* and 312*a* may contain at least one of Mo, Cr, Cu and Ti, while the second conductive layers 311*b* and 312*b* may contain Cu. As another non-limited example, when the first conductive layers 311*a* and 312*a* are formed by electroless plating and the second conductive layers 311*b* and 312*b* are formed by electroplating, the first and second conductive layers 311*a*, 312*a*, 311*b* and 312*b* may contain Cu. In this case, a density of Cu in the first conductive layers 311*a* and 312*a* may be lower than that in the second conductive layers 311*b* and 312*b*.

The external electrodes 400 and 500 are disposed on a surface of the body 100 and are connected to both ends of the coil portion 300. In the present exemplary embodiment, both ends of the coil portion 300 are exposed to the first and second surfaces 101 and 102 of the body 100, respectively. Accordingly, the first external electrode 400 is disposed on the first surface 101 to be contact-connected to the end of the first coil pattern 311 exposed to the first surface 101 of the body, while the second external electrode 500 is disposed on the second surface 102 to be contact-connected to the end of the second coil pattern 312 exposed to the second surface 103 of the body 100.

The external electrodes 400 and 500 may be formed of a conductive material, such as Cu, Al, Ag, Sn, Au, Ni, Pb, Ti or alloys thereof, but is not limited thereto.

The external electrodes 400 and 500 may be formed in a single layer or multiple layers. As an example, the first external electrode 400 may be formed to have a first layer containing Cu, a second layer disposed on the first layer and containing Ni and a third layer disposed on the second layer and containing Sn. The first to third layers may be formed by plating but are not limited thereto. As another example, the first electrode layer 400 may include a resin electrode layer containing a conductive powder and a resin, and a plating layer plated on the resin electrode layer. In this case, the resin electrode layer may contain a cured product of a thermosetting resin and at least one conductive powder of Cu and Ag. Further, the plating layer may include a first plating layer containing Ni and a second plating layer containing Sn. When the resin contained in the resin electrode layer contains a resin identical to the insulating resin R of the body 100, a binding force between the resin electrode layer and the body 100 may be enhanced.

The insulating film 500 may be formed on the insulating substrate 200 and the coil portion 300. The insulating film 500 is to insulate the coil portion 300 from the body 100, and may contain a known insulating material such as parylene. Any insulating material can be contained in the insulating film 600 and is not particularly limited. The insulating film 600 may be formed by a vapor deposition method, or the like, but is not limited thereto. The insulating film 600 may be formed by stacking insulating films on both surface of the insulating substrate 20. In the former case, the insulating film 600 may be formed in the form of a conformal film along a surface of the coil portion 300 and the insulating substrate 200. In this case, at least some of the magnetic metal powder particles 11 to 13 may be filled in a space between turns adjacent to the coil patterns 311 and 312 in which the conformal insulating film 600 is formed. In the latter case, the insulating film 600 may be formed in the form of filling the space between the turns adjacent to the coil patterns 311 and 312. Meanwhile, as previously described, the plating resist for forming the second conductive layers 311*b* and 312*b* may be formed on the insulating substrate 200, and such plating resist may be permanent and is not removed. In this case, the insulating film 600 may be a plating resist, a permanent resist. Meanwhile, the insulating film 600 in the present disclosure is a selective configuration, and may thus be omitted as long as the body 100 can secure sufficient insulation resistance under the operational conditions of the coil component 1000 according to the present exemplary embodiment.

Experimental Examples 1 to 3 below are carried out by preparing the coil components comprising a body including the first magnetic metal powder particle, the second magnetic metal powder particle and the third magnetic metal powder particle while varying the contents (at %) of Si in the core of the first magnetic metal powder.

In Table 1 below, the expression "independent leakage voltage" is a leakage voltage measured only for the first magnetic metal powder. The expression "trimodal leakage voltage" is a leakage voltage of the body measured after the body containing the second and third magnetic metal powder particles is formed.

Meanwhile, Experimental Examples 1 to 3 are identical except the Si contents (at %) of the core 11-1. That is, a diameter of the first magnetic metal powder particle and a weight percentage (wt %) based on the entire body are identical in Experimental Examples 1 to 3 (so do the second and third magnetic metal powder particles). Further, the compositions of the second and third magnetic metal powder particles are identical in Experimental Examples 1 to 3. Also, the second magnetic metal powder had a larger diameter than the first magnetic metal powder particle, and the third magnetic metal powder particle had a larger diameter than the second magnetic metal powder particle. The first magnetic metal powder of Experimental Examples 1 to 3 included the core represented by Formula 1 except for that the silicon contents were specified in Table 1 below.

TABLE 1

| | | Independent Leakage Voltage | | |
|---|---|---|---|---|
| | Si (at %) | Leakage Voltage (V) | Leakage Voltage (V/mm) | Trimodal Leakage Voltage (V/mm) |
| 1 | 2.017 | 12.25 | 4.62 | 10.7 |
| 2 | 3.104 | 1000 | 329.32 | 34.3 |
| 3 | 4.161 | 1000 | 357.91 | 82.1 |

Based on Table 1, Experimental Examples 2 and 3 satisfying the range of Formula 1 show increased leakage voltage and trimodal leakage voltage and thus increased insulation resistance characteristics.

Specifically, Experimental Example 1, which does not satisfy the range of Formula 1 with respect to the Si content, exhibits deteriorated insulation resistance characteristics due to insufficient formation of oxide films on the surface of the core. In the case of Experimental Examples 2 and 3 satisfying the range of Formula 1 with respect to the Si content, however, a silicon oxide film is formed on the surface of the core to have a sufficient thickness, thereby giving rise to enhanced insulation resistance characteristics of the first magnetic metal powder particle itself as well as the trimodal body containing the first magnetic metal powder particles.

Figure 7:
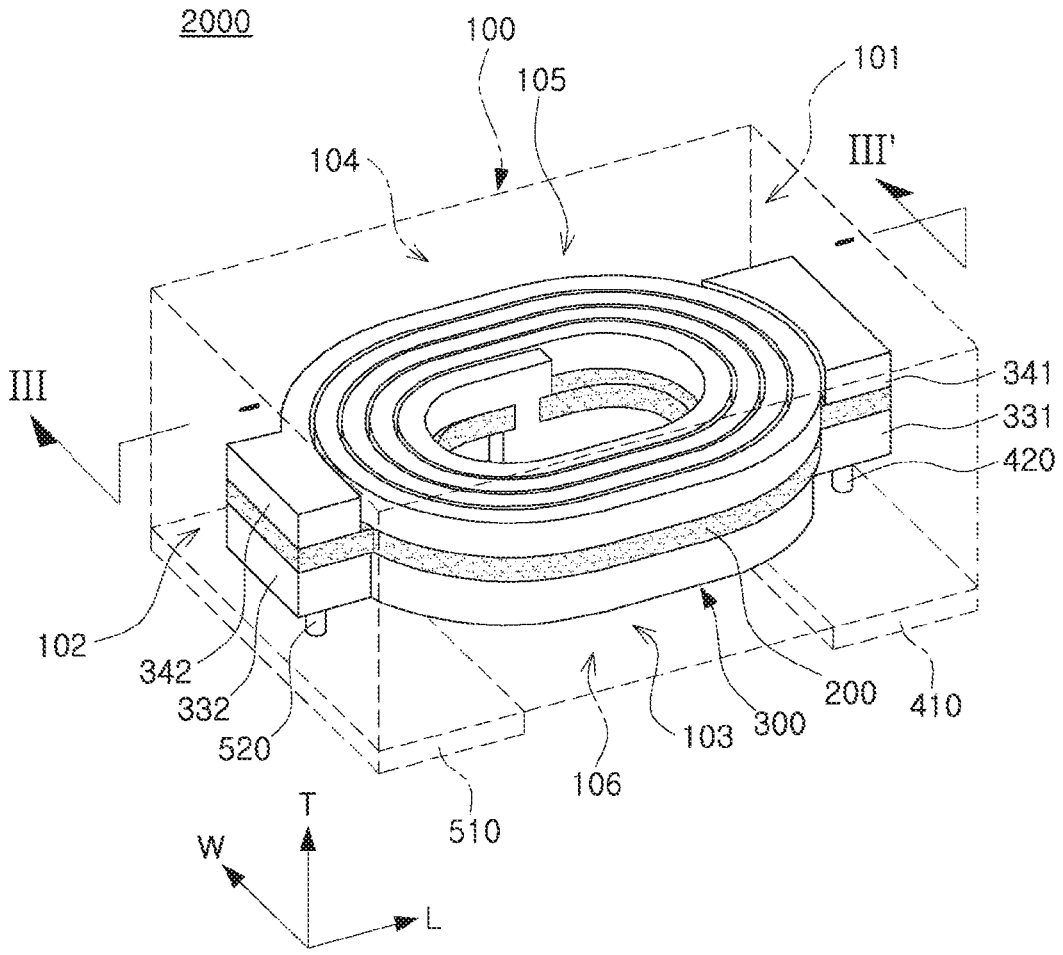
FIG. 7 is a schematic diagram illustrating a coil component according to another exemplary embodiment.
Figure 8:
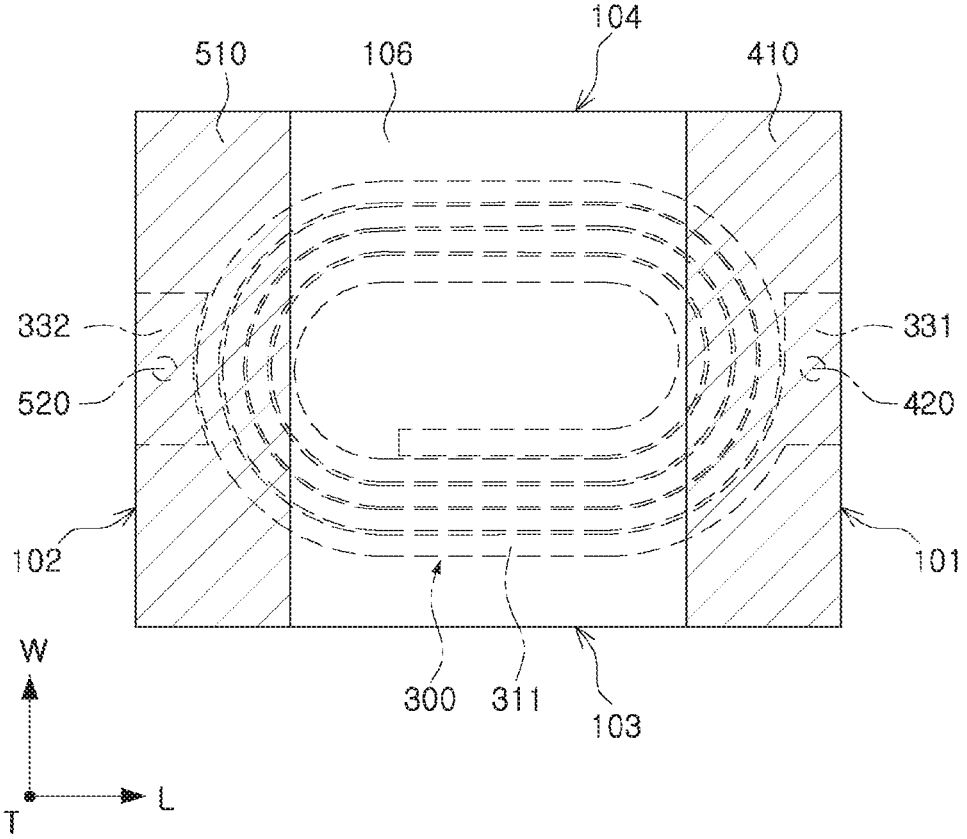
FIG. 8 is a diagram illustrating the coil component of FIG. 7 viewed from a lower portion.
Figure 9:
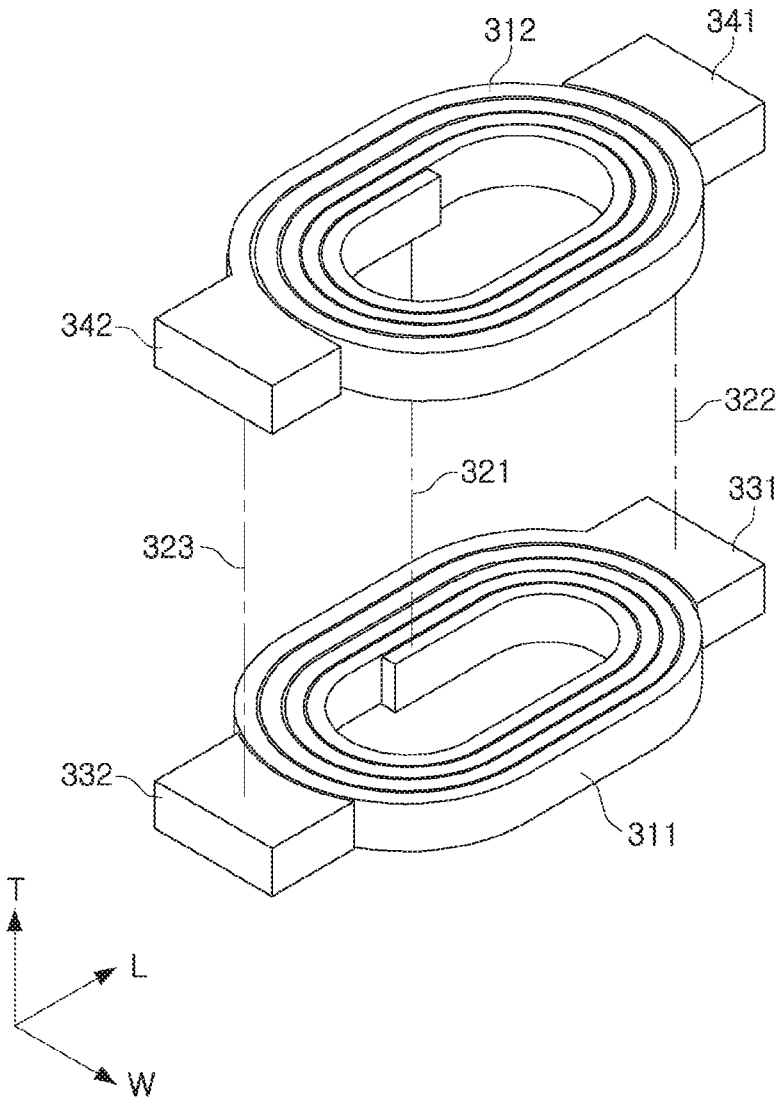
FIG. 9 is a schematic diagram illustrating a coil component according to Experimental Example 3 and corresponding to the cross-section taken along line I-I' of FIG. 1.
Figure 10:
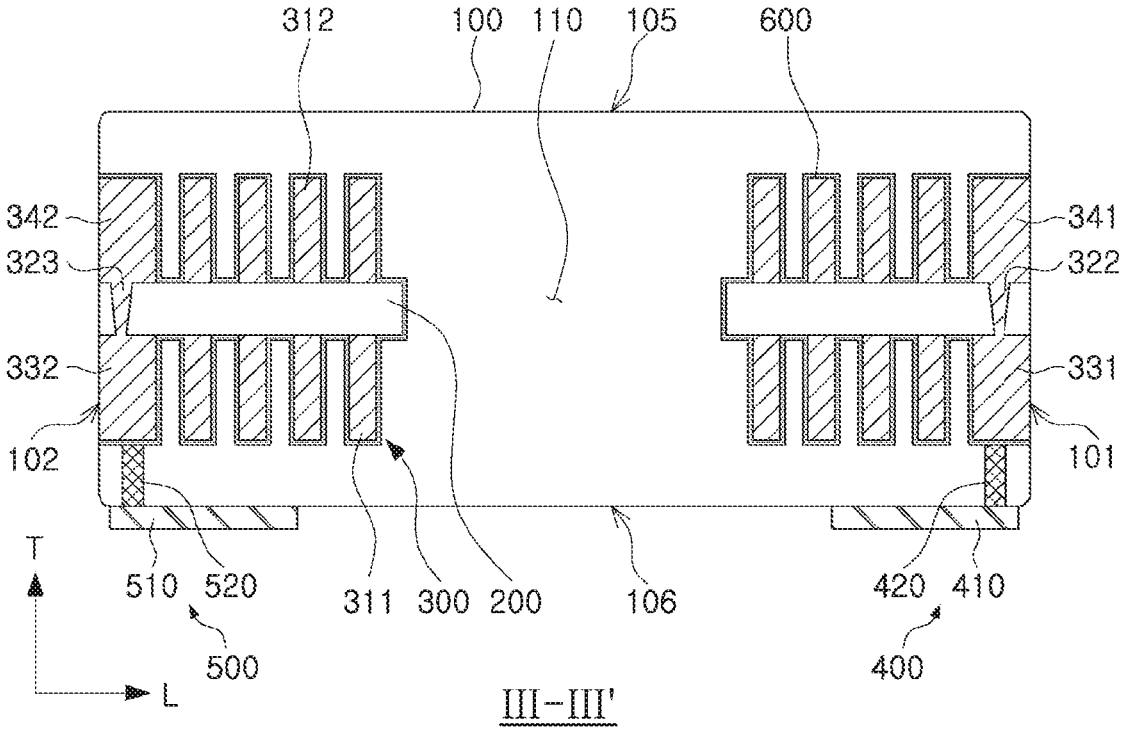
FIG. 10 is a cross-sectional view taken along line III-III' of FIG. 7.

FIG. 7 is a schematic diagram illustrating a coil component according to another exemplary embodiment, and FIG. 8 is a diagram illustrating the coil component of FIG. 7 viewed from a lower portion. FIG. 9 is a schematic diagram illustrating a coil component according to Experimental Example 3 and corresponding to the cross-section taken along line I-I' of FIG. 1, and FIG. 10 is a cross-sectional view taken along line of FIG. 7.

Based on FIGS. 1 to 6 together with FIGS. 7 to 10, a coil component 2000 according to the present exemplary embodiment is different in terms of the coil portion 300 and the external electrodes 400 and 500 when compared to the coil component 1000 according to the previous exemplary embodiment. Accordingly, the coil portion 300 and the external electrodes 400 and 500 will only be described based on the differences therebetween. The description of the remaining constitutions in the previous exemplary embodiment can be applied, as it is or modified, to the present exemplary embodiment.

The coil portion 300 applied to the present exemplary embodiment includes coil patterns 311 and 312, lead-out patterns 331 and 332, auxiliary lead-out patterns 341 and 342 and vias 321, 322 and 323.

Specifically, based on the directions of FIGS. 7 to 10, a first coil pattern 311, a first lead-out pattern 331 and a second lead-out pattern 332 are disposed on the lower surface of the insulating substrate 200 facing the sixth surface 106 of the body, and a second coil pattern 312, a first auxiliary lead-out pattern 341 and a second auxiliary lead-out pattern 342 are disposed on the upper surface of the insulating substrate 200 facing the fifth surface 105 of the body. The lead-out patterns 331 and 332 of the present exemplary embodiment are configured to be contact-connected to the external electrodes 400 and 500, similarly to both ends of the first and second coil patterns 311 and 312 described in the previous exemplary embodiment.

Based on FIGS. 7, 9 and 10, the first coil pattern 311 is in contact with the first lead-out pattern 331 on the lower surface of the insulating substrate, and the first coil pattern 311 and the first lead-out pattern 331 are spaced apart from the second lead-out pattern 332. The second coil pattern 312 is in contact with the second auxiliary lead-out pattern 342 on the upper surface of the insulating substrate 200, and the second coil pattern 312 and the second auxiliary lead-out pattern 342 are spaced apart from the first auxiliary lead-out pattern 341. The first via 321 penetrates the insulating substrate 200 to be in contact with inner ends of the first and second coil patterns 311 and 312, and the second via 322 penetrates the insulating substrate 200 to be in contact with the second lead-out pattern 332 and the second auxiliary lead-out pattern 342. This enables the coil portion 200 as a while to function as a single coil.

The lead-out patterns 331 and 332 and the auxiliary lead-out patterns 341 and 342 are exposed to both cross-sections of the body 100. That is, the first lead-out pattern 331 and the first auxiliary lead-out pattern 341 are exposed to the first surface 101 of the body 100 and the second lead-out pattern 332 and the second auxiliary lead-out pattern 342 are exposed to the second surface 102 of the body 100.

At least one of the coil patterns 311 and 312, the vias 321, 322 and 323, the lead-out patterns 331 and 332 and the auxiliary lead-out patterns 341 and 342 may include at least one conductive layer.

As an example, when the second coil pattern 312, the auxiliary lead-out patterns 341 and 342 and the vias 321, 322 and 323 are formed plated on the other surface of the insulating substrate 200, each of the second coil pattern 312, the auxiliary lead-out patterns 341 and 342 and the vias 321, 322 and 323 may include at least one conductive layer such as a seed layer and/or an electroplating layer. The seed layer may be an electroless plating layer. In this case, the electroplating layer may have a single layer structure or a multilayer structure. The multilayered electroplating layer may be formed in the form of a conformal film, in which one electroplating layer is covered by another electroplating layer, or in the form in which an electroplating layer is stacked only on one surface of another electroplating layer. The seed layer of the second coil pattern 312, those of the auxiliary lead-out patterns 341 and 342 and those of the vias 321, 322 and 323 are integrally formed and may thus not have a boundary formed therebetween, but are not limited thereto. The electroplating layer of the second pattern 312, those of the auxiliary lead-out patterns 341 and 342 and those of the vias 321, 322 and 323 are integrally formed and may thus not have a boundary formed therebetween, but are not limited thereto.

Based on FIGS. 7 and 10, the coil patterns 311 and 312, the lead-out patterns 331 and 332 and the auxiliary lead-out patterns 341 and 342 may be formed to extrude from the lower and upper surfaces of the insulating substrate 200. As another example, the first coil pattern 311 and the lead-out patterns 331 and 332 are formed to extrude from the lower surface of the insulating substrate 200, and the second coil pattern 312 and the auxiliary lead-out patterns 341 and 342 are embedded in the upper surface of the insulating substrate 200 such that the upper surface of each of the second coil pattern 312 and the auxiliary lead-out patterns 341 and 342 are exposed onto the upper surface of the insulating substrate 200. In this case, a recess portion is formed on the upper surface of the second coil pattern 312 and/or the auxiliary lead-out patterns 341 and 342, thereby making the upper surface of the second coil pattern 312 and/or the auxiliary lead-out patterns 341 and 342 and that of the insulating substrate 200 not on the same planar, and vice versa as another example.

The coil patterns 311 and 312, the lead-out patterns 331 and 332, the auxiliary lead-out patterns 341 and 342 and the vias 321, 322 and 323 may be formed of a conductive material such as Cu, Al, Ag, Sn, Au, Ni, Pb, Ti or alloys thereof, but are not limited thereto.

Meanwhile, based on FIG. 9, the auxiliary lead-out pattern 341 is irrelevant to electrical connections between the remaining configurations of the coil portion 300 and may thus be omitted. However, it is preferable that the first auxiliary lead-out pattern 341 be formed to skip a process of distinguishing the fifth and sixth surfaces of the body 100.

The first and second external electrodes 400 and 500 include first and second connection portion 420 and 520 and first and second pad portions 410 and 510 spaced apart from each other on the sixth surface 106 of the body 100. Specifically, the first external electrode 400 includes the first pad portion 410 formed on the sixth surface 106 of the body 100 and the first connection portion 420 penetrating at least a portion of the body 100 to be contact-connected to the first lead-out pattern 331 of the coil portion 300 and the first pad portion 410. The second external electrode 500 includes the second pad portion 510 formed on the sixth surface 106 of the body 100 and the second connection portion 520 penetrating at least a portion of the body 100 to be contact-connected to the second lead-out pattern 332 of the coil portion 300 and the second pad portion 510.

The first and second pad portions 410 and 510 may be formed in a single layer or multiple layers. As an example, the first pad portion 410 may be formed to have a first layer containing Cu, a second layer disposed on the first layer and containing Ni and a third layer disposed on the second layer and containing Sn.

The first and second connection portions 420 and 520 penetrate at least a portion of the body 100. That is, in the case of the present exemplary embodiment, the first and second pad portions 410 and 510 are connected to the first and second lead-out patterns 331 and 332 through the first and second connection portions 420 and 520 disposed inside the body; the first and second external electrodes 400 and 500 are not connected to the first and second lead-out patterns 331 and 332 through the surface of the body 100.

The first and second connection portions 420 and 520 may extend from the coil portion 300. As an example, the first and second connection portions 420 and 520 may grow by plating from the first and second lead-out patterns 331 and 332 exposed through an opening of a plating resist after forming the plating resist having the opening on the first and second lead-out patterns 331 and 332. Alternately, the first and second connection portions 420 and 520 may be formed by forming the body 100 and forming a via hole on the sixth surface of the body 100 followed by filling a conductive material in the via hole. In the former case, the first and second lead-out patterns 331 and 332 may serve as feeding layers in forming the first and second connection portions 420 and 620 by electroplating. As a result, a seed layer, such as an electroless plating layer, may not be present at a boundary between the first and second connection portions 420 and 520 and the coil portion 300, but is not limited thereto. In the latter case, the first and second connection portions 420 and 520 may include a seed layer formed inside the via hole, but are not limited thereto.

Meanwhile, FIGS. 7, 8 and 10 illustrate each of the first and second connection portions 420 and 520 unitarily formed to have a cylindrical shape; however, this is merely for convenience in illustration and description thereof. As another non-limited example, the first connection portion 420 may be formed in plural and in the form of a square pillar.

Figure 11:
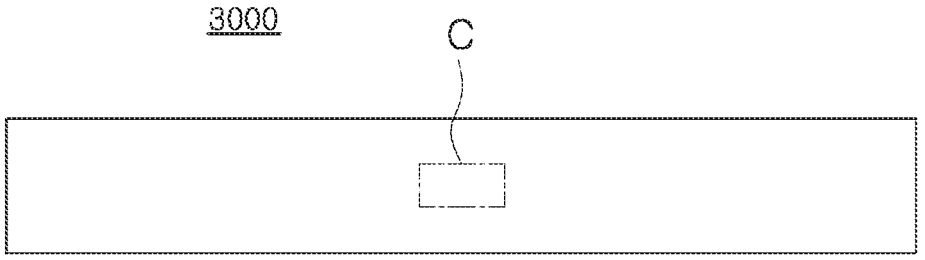
FIG. 11 is a schematic diagram illustrating a magnetic composite sheet according to an exemplary embodiment.
Figure 12:
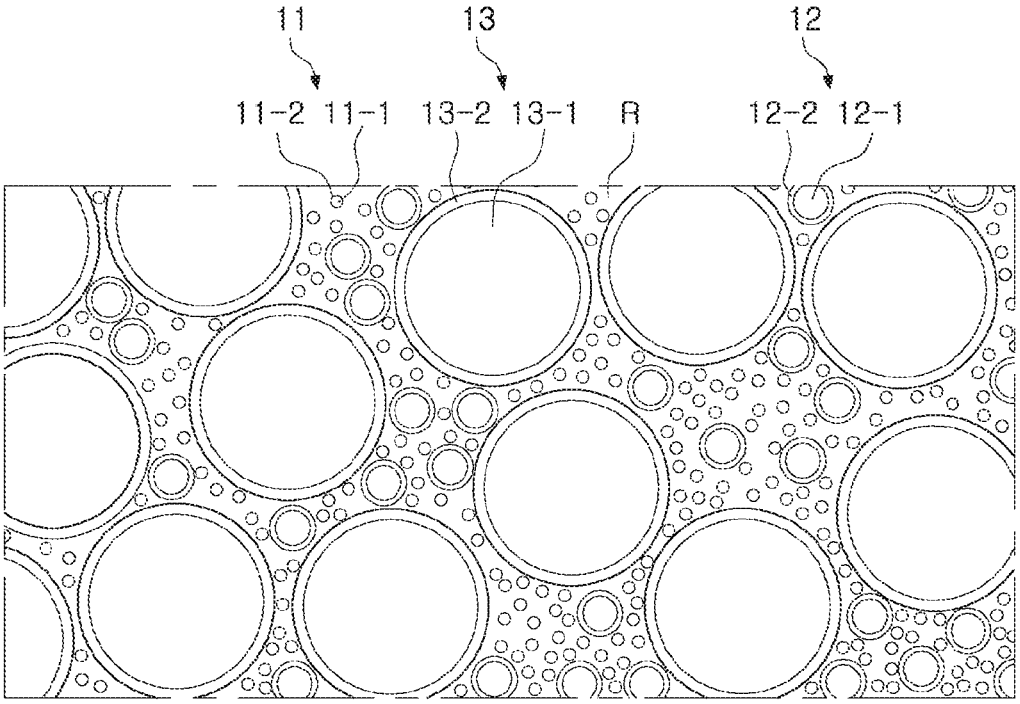
FIG. 12 an enlarged view of "C" of FIG. 11.

FIG. 11 is a schematic diagram illustrating a magnetic composite sheet according to an exemplary embodiment, and FIG. 12 an enlarged view of "C" of FIG. 11.

Based on FIGS. 11 and 12, a magnetic composite sheet 3000 according to an exemplary embodiment includes a first magnetic metal powder particle 11, a second magnetic metal powder particle 12, a third magnetic metal powder particle 13 and an insulating resin R.

The first to third magnetic metal powder particles 11 to 13 are described in the coil component 1000 according to the one exemplary embodiment above, and the description thereof will be omitted.

Meanwhile, the insulating resin R of the magnetic composite sheet 3000 according to the present exemplary embodiment, in contrast to that described in the coil component 1000 of one of the previous exemplary embodiments, is uncured or semi-cured. That is, the insulating resin R of the present disclosure is uncured or semi-cured in the magnetic composite sheet 3000 as in the present exemplary embodiment and becomes cured in the body 100 formed by stacking such magnetic composite sheet 3000 on the insulating substrate 200 and curing the same.

Meanwhile, although not illustrated, the magnetic composite sheet 3000 according to the present exemplary embodiment may include a functional layer containing the first to third magnetic metal powder particles 11 to 13 and the insulating resin R, a support film disposed on one surface of the functional layer and a protective film on the other surface of the functional layer. In the case of the magnetic composite sheet 3000, the protective film is removed such that the functional layer faces the insulating substrate 200 and stacked thereon. The stacked support film may then be removed.

As set forth above, according to the present disclosure, a leakage current of a coil component containing three or more magnetic metal powder particles having different diameters can be reduced.

While exemplary embodiments have been shown and described above, it will be apparent to those skilled in the art that modifications and variations could be made without departing from the scope of the present disclosure as defined by the appended claims.

What is claimed is:

1. A coil component, comprising a body and a coil portion embedded in the body, wherein the body comprises:

a first magnetic particle comprising a core comprising a compound represented by Formula 1 below, and an oxide film comprising at least one of silicon (Si) or chromium (Cr) and directly deposited on a surface of the core;

a second magnetic particle having a larger diameter than the first magnetic particle; and a third magnetic particle having a larger diameter than the second magnetic particle:

$Fe_aSi_bCr_c$ [Formula 1]

where 3 atom %≤b≤6 atom %, 2.65 atom %≤c≤3.65 atom %, and a+b+C=100, wherein each of the second and third magnetic particles comprises a metal particle and an insulating coating layer directly disposed on a surface of the second and third metal particles, wherein the insulating coating layer comprises an insulating resin.

2. The coil component of claim 1, wherein the diameter of the first magnetic particle is less than 1 μm.

3. The coil component of claim 1, wherein the diameter of the first magnetic particle is 0.1 μm to 0.2 μm.

4. The coil component of claim 1, wherein:

the diameter of the second magnetic particle is 1 μm to 2 μm, and the diameter of the third magnetic particle is 25 μm to 30 μm.

5. The coil component of claim 1, wherein a thickness of the coil component is 0.85 mm or less.

6. The coil component of claim 1, wherein each of the metal particles of the second and third magnetic particles comprises an iron(Fe)-silicon(Si)-boron(B)-copper(Cu)-base alloy powder.

7. The coil component of claim 1, further comprising first and second external electrodes spaced apart on an outer surface of the body, and connected to both ends of the coil portion exposed to the outer surface of the body.

8. The coil component of claim 1, wherein the coil component further comprises an insulating substrate embedded in the body, wherein the coil portion comprises first and second coil pattern disposed respectively on one surface and the other surface of the insulating substrate facing each other.

9. The coil component of claim 8, wherein each of the first and second coil patterns comprises a first conductive layer formed on the insulating substrate and a second conductive layer formed on the first conductive layer.

10. The coil component of claim 9, wherein each of the first and second conductive layers comprises copper (Cu), and a density of the copper of the first conductive layer is lower than a density of the copper of the second conductive layer.

11. The coil component of claim 9, wherein a side surface of the first conductive layer is exposed by the second conductive layer.

12. The coil component of claim 9, wherein the second conductive layer covers a side surface of the first conductive layer and contacts the insulating substrate.

13. The coil component of claim 1, wherein the insulating resin comprises an epoxy resin.

14. The coil component of claim 1, wherein the insulating resin comprises an polyamide resin.

15. The coil component of claim 1, wherein a thickness of the insulating coating layers of the second and third magnetic particles is greater than 0.01 μm and less than 1 μm.

16. A magnetic composite sheet, comprising:

a first magnetic particle comprising a core comprising a compound represented by Formula 1 below, and an oxide film comprising at least one of silicon (Si) or chromium (Cr) and directly formed on a surface of the core, a second magnetic particle having a larger diameter than the first magnetic particle, a third magnetic particle having a larger diameter than the second magnetic particle; and an insulating resin:

$Fe_aSi_bCr_c$ [Formula 1]

where 3 atom %≤b≤6 atom %, 2.65 atom %≤c≤3.65 atom %, and a+b+C=100, wherein each of the second and third magnetic particles comprises a metal particle and an insulating coating layer directly disposed on a surface of the second and third metal particles, wherein the insulating coating layer comprises an insulating resin.

17. The magnetic composite sheet of claim 16, wherein the diameter of the first magnetic particle is 0.1 μm to 0.2 μm.

18. The magnetic composite sheet of claim 16, wherein:

the diameter of the second magnetic particle is 1 μm to 2 μm, and the diameter of the third magnetic particle is 25 μm to 30 μm.

* * * * *